United States Patent [19]

Wood

[11] Patent Number: 4,652,790

[45] Date of Patent: Mar. 24, 1987

[54] ELECTRODELESS DISCHARGE LAMP

[75] Inventor: Charles H. Wood, Rockville, Md.

[73] Assignee: Fusion Systems Corporation, Rockville, Md.

[21] Appl. No.: 797,083

[22] Filed: Nov. 12, 1985

[51] Int. Cl.[4] ..... H01J 61/30; H01J 61/54

[52] U.S. Cl. ..... 313/112; 313/634; 313/636; 315/248; 315/150

[58] Field of Search ..... 315/248, 150; 313/634, 313/636, 112

[56] References Cited

U.S. PATENT DOCUMENTS

| | | | |
|---|---|---|---|
| 2,326,773 | 8/1943 | Floyd | 313/112 X |
| 2,757,305 | 7/1956 | Dziergwa | 313/634 X |
| 3,451,579 | 6/1969 | Bishop | 313/636 X |
| 4,185,228 | 1/1980 | Regan | 315/248 X |
| 4,307,315 | 12/1981 | Meulemans et al. | 313/634 |
| 4,359,668 | 11/1982 | Ury | 315/248 X |

*Primary Examiner*—Palmer C. DeMeo

*Attorney, Agent, or Firm*—Pollock, Vande Sande & Priddy

[57] ABSTRACT

An electrodeless discharge lamp having an ultraviolet radiation transmission envelope containing a plasma-forming medium. The envelope is formed from two different types of quartz, one of which blocks transmission of ultraviolet radiation 253 nm and shorter, and the other of which transmits radiation of 253 nm or shorter. The quartz which transmits the short wavelength radiation serves as a window for transmitting into the envelope ultraviolet having a wavelength short enough to initiate ionization of the plasma-forming medium within the envelope.

3 Claims, 4 Drawing Figures

ELECTRODELESS DISCHARGE LAMP

The present invention relates to electrodeless discharge lamps, and more particularly to electrodeless discharge lamps having ultraviolet transmission envelope containing a plasma-forming medium.

In general, electrodeless discharge lamps are well known in the art and comprise a radiation transmissive envelope containing a plasma-forming medium, a microwave source, means for coupling energy from the microwave source to the envelope and means to initiate ionization of a plasma-forming medium.

In order to initiate breakdown of the plasma-forming medium in electrodeless discharge lamps, external radiation may be applied to the medium. This radiation causes an initial electron to be freed from an atom, the initial electron strikes other atoms and causes additional electrons to be freed, and an avalanche effect follows, thus causing a discharge of radiation. In a typical electrodeless discharge lamp, the plasma-forming medium is mercury which is ionized by low level ultraviolet radiation having a short wavelength, i.e., a wavelength of about 253 nanometers (nm) or shorter, and the resulting plasma emits ultraviolet radiation having a wide range of wavelengths, i.e., wavelengths from 450 nm and greater down to 200 nanometers or less.

Short wavelength radiation, i.e., radiation having wavelengths shorter than about 250 nm may have some undesirable effects, and it is preferred in some applications to have no wavelengths shorter than about 280 nm emitted.

The radiation transmissive envelopes for electroless discharge lamps are typically made of quartz since quartz is available which will block the emission of radiation having wavelengths below about 280 nm. However, the use of such quartz as the radiation transmissive envelope presents problems in the use of the electrodeless lamps which are initiated by introducing radiation having a wavelength shorter than about 280 nm into the envelope from an exterior source. The desired characteristic of an electrodeless lamp of emitting substantially no radiation having a wavelength below about 280 nm. is apparently incompatible with the traditional use of exterior radiation as an initiator.

The use of the term "quartz" herein refers to fused silica which may be doped with small concentrations of other materials.

SUMMARY OF THE INVENTION

It is accordingly one object of this invention to provide an envelope for an electrodeless discharge lamp which is capable of being initiated by an external source of ultraviolet radiation and yet emits relatively insignificant power levels of radiation having wavelengths below about 280 nm and substantially no radiation having a wavelength below about 250 nm.

In accordance with this invention, there is provided an electrodeless discharge lamp comprising an ultraviolet transmission envelope containing a plasma-forming medium, said envelope comprising a first ultraviolet transmissive portion and a second ultraviolet transmissive portion, said first ultraviolet transmissive portion comprising quartz which blocks transmission of substantially all ultraviolet radiation having wavelengths of about 253 nm. and shorter and said second ultraviolet transmissive portion comprising quartz which is capable of transmitting ultraviolet having a wide range of wavelengths including wavelengths shorter than about 253 nm, said second ultraviolet transmissive portion having an area sufficient to transmit enough ionizing ultraviolet radiation to initiate the ignition of the plasma-forming medium.

The second ultraviolet transmissive portion of the envelope serves as a window for shortwave ultraviolet to initiate ionization, such window having a sufficiently small percent of the total envelope area so that radiation emitted from the envelope through the window which has a wavelength shorter than about 250 nm is a minor part of the total radiation emitted, and consequently does not present a significant problem.

DETAILED DESCRIPTION OF THE INVENTION

This invention is an envelope or bulb for containing a plasma-forming medium in a system for producing ultraviolet radiation by exciting the plasma-forming medium with microwave energy. The other components which may be used in the system such as the source of the microwave energy, the system for coupling the microwave energy to the envelope and the igniter bulb do not constitute a part of this invention and conventional components well known in the art may be used. For example, U.S. Pat. No. 4,359,668 to Ury for "Method and Apparatus for Igniting Electrodeless Discharge Lamp" describes a system for coupling microwave energy to the envelope and igniter bulbs which may be used with the envelope. Japanese Patent Publication Nos. 57-202693 and 58-194244, each for a "Microwave Discharge Light Source Device" describe systems in which an auxiliary starter bulb is employed.

Figure 1:
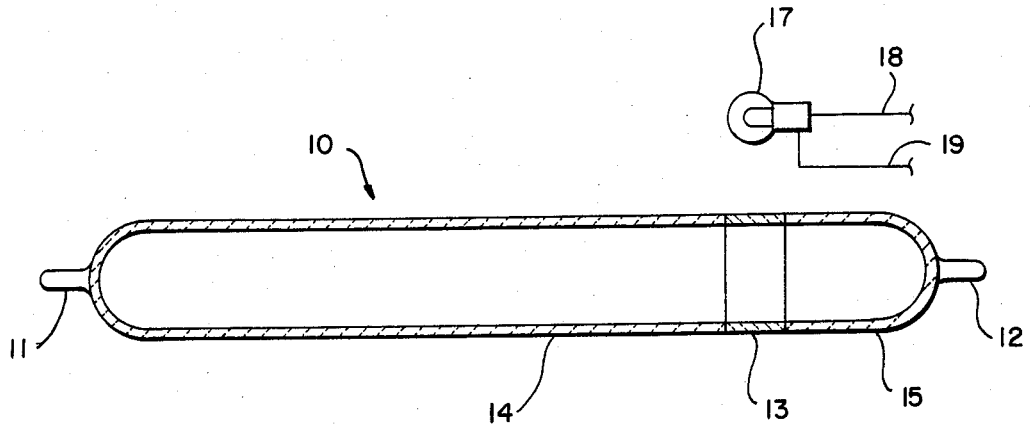
FIG. 1 is a cross-sectional view of an envelope for an electrodeless discharge lamp made in accordance with this invention in which the envelope has a circular cross-section.
Figure 2:
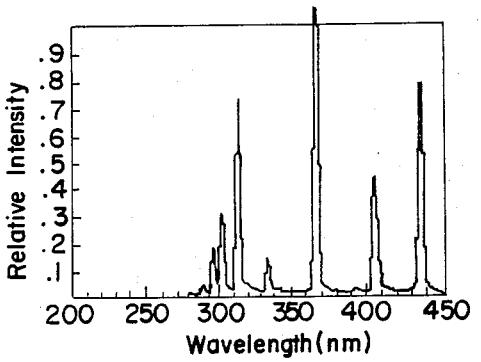
FIG. 2 is a graph showing the relative intensities of various wavelengths of ultraviolet radiation which is emitted by a mercury plasma and transmitted through a substantially pure quartz envelope which is doped to block substantially all wavelengths below 280 nm.
Figure 4:
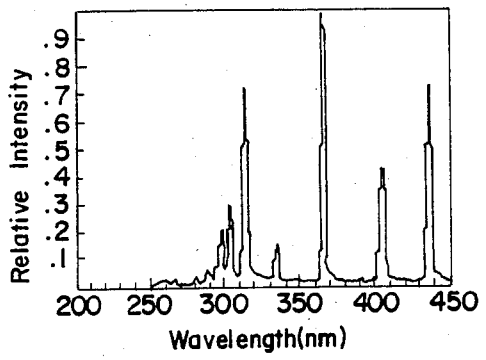
FIG. 4 is a graph showing the relative intensities of various wavelenghts of ultraviolet radiation which is emitted by a mercury plasma and transmitted through an envelope constructed in accordance with FIG. 1.

An embodiment of the invention is disclosed in FIG. 1 wherein portions 14 and 15 of envelope 10 are made of a quartz which has radiation transmission characteristics as shown in FIG. 2. A window section identified as 13 is made of quartz having the property of transmitting significant quantities of radiation having wavelengths as short as about 250 nm. Igniter bulb 17 receiving energy through lines 18, 19 is positioned near window 13. When mercury within the envelope 10 is exposed through window 13 to ultraviolet radiation including wavelengths of about 253 nm or shorter, a plasma is formed and resulting radiation which is emitted upon coupling the plasma to a source of microwave energy has a wavelength distribution as shown in FIG. 4.

The position of the window is not critical and may be in any area of the envelope which can be irradiated by an igniter bulb. The shape of the window is not critical, and for ease of manufacture, the shape will typically be dictated by the ultimate configuration of the envelope itself. For example, if the envelope comprises an elongated cylindrical body, as shown in FIG. 1, a short cylindrical section of quartz having the desired transmission properties may be fused between two cylindrical sections each of which is made of quartz which is capable of blocking short wavelength ultraviolet radiation.

The amount of area occupied by the windows is preferably selected to minimize the emission of radiation having a wavelength shorter than about 280 nm, while providing an area great enough for passing sufficient radiation from the igniter bulb to initiate the discharge from the envelope.

The area of the window relative to the total area of the envelope depends to some extent on the shape of the envelope and the configuration of the windows. For cylindrical envelopes with circular cross-sections as shown in FIG. 1, a window having an area from about 1% to about 25% of the total envelope area is suitable. The most desirable window area depends to some extent on the particular application and the shape and position of the window. For most applications, it is preferred that the window area be relatively small, such as, for example, 1% to about 5% or even 1% to about 3%.

The window must be made of quartz which is capable of transmitting ultraviolet radiation having a wavelength of 253 nm or shorter, while the remainder of the envelope is made of quartz which blocks substantially all radiation shorter than about 253 nm and preferably blocks substantially all radiation shorter than about 280 nm.

The optical transmission properties of quartz depend to some extent on the impurities contained in the quartz. For example, it is known that doping quartz with impurities such as titanium dioxide increases the absorption of ultraviolet radiation by the quartz, and quartz which is doped with such impurities and thus substantially blocks transmission of short wavelength ultraviolet radiation is available commercially.

FIG. 2 shows the relative intensities of various wavelengths of ultraviolet radiation which is emitted from a mercury plasma and which passes through a quartz envelope which is doped to block short ultraviolet wavelengths. As can be seen from the graph, substantially no radiation having a wavelength shorter than about 280 nm is transmitted through the envelope.

Quartz having a low concentration of impurities for use as a window for short wavelength ultraviolet radiation is also available commercially, and the suitability of a specific composition of quartz for use either as the window or as the major area of the envelope can readily be determined by measuring the ultraviolet transmission properties of the quartz under consideration.

Figure 3:
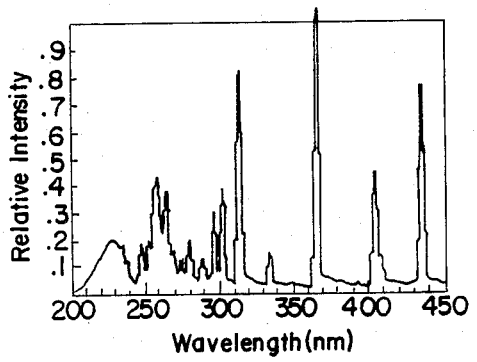
FIG. 3 is a graph showing the relative intensities of various wavelengths of ultraviolet radiation which is emitted by a mercury plasma and transmitted through a substantially pure quartz envelope which is transparent to ultraviolet wavelengths from a range above 450 nm to about 200 nm or shorter.

FIG. 3 shows the relative intensities of various wavelengths of ultraviolet radiation which is emitted from a mercury plasma and which passes through a quartz envelope in which the quartz is substantially transparent to ultraviolet in a broad range from below 200 nm to above 450 nm.

Having thus described the invention, the following Example is offered to illustrate it in more detail.

EXAMPLE

An electrodeless discharge lamp was constructed as shown in FIG. 1. The bulb was formed from quartz tubing having an outside diameter of 11 mm and an inside diameter of 9 mm, with an overall length of about six inches and a window about 0.2 inches in length.

The window was formed from commercially available quartz identified as Type 219 which was obtained from the General Electric Company, and the remainder of the envelope was formed from quartz identified as Type M-84, obtained from Heraeus-Amersil. The type 219 quartz transmitted signficant amounts of ultraviolet having wavelengths as short as about 250 nm, and the Type M-84 quartz had ultraviolet transmission properties as shown in FIG. 2.

A small quantity of mercury in the envelope was ignited by a bulb positioned near the window. The igniter bulb was a 4 watt bulb emitting radiation including ultraviolet at a wavelength of 253 nm. The resulting radiation which was emitted from the mercury plasma and transmitted through the envelope was measured and the relative intensities of various wavelengths of radiation transmitted through the envelope is shown in FIG. 4.

What is claimed is:

1. An electrodeless discharge lamp comprising an ultraviolet radiation transmissive envelope containing a plasma-forming medium, said envelope comprising a first ultraviolet transmissive portion and a second ultraviolet transmissive portion, said first ultraviolet transmissive portion comprising quartz which blocks transmission of substantially all ultraviolet having wavelengths of about 253 nanometers and shorter, and said second ultraviolet transmissive portion comprising quartz which is capable of transmitting ultraviolet radiation having a wide range of wavelengths including wavelengths of about 253 nanometers or shorter, said second ultraviolet transmissive portion having an area great enough to transmit a sufficient amount of ionizing ultraviolet radiation to initiate the ionization of the plasma-forming medium.

2. An electrodeless discharge lamp in accordance with claim 1 in which said first ultraviolet transmissive portion comprises from about 75% to about 99% and said second ultraviolet transmissive portion comprises from about 1% to about 25% of the ultraviolet transmissive area of said envelope.

3. An electrodeless discharge lamp in accordance with claim 1 in which said first ultraviolet transmissive portion comprises quartz which blocks transmission of substantially all ultraviolet below a wavelength of about 280 nanometers.

* * * * *